United States Patent [19]

Duenisch et al.

[11] Patent Number: 4,896,072

[45] Date of Patent: Jan. 23, 1990

[54] FLASHBULB WITH A HEAT SHIELD

[75] Inventors: Ingo Duenisch, Taunusstein; Dieter Eierle-Tschirner, Wiesbaden, both of Fed. Rep. of Germany

[73] Assignee: Heimann GmbH, Fed. Rep. of Germany

[21] Appl. No.: 151,752

[22] Filed: Feb. 3, 1988

[30] Foreign Application Priority Data

Feb. 6, 1987 [DE] Fed. Rep. of Germany ..... 3703690

[51] Int. Cl.[4] ..... H01J 61/30; H01J 61/80; H01J 61/90

[52] U.S. Cl. ..... 313/610; 313/634; 313/636

[58] Field of Search ..... 313/33, 610, 636, 634, 313/635

[56] References Cited

U.S. PATENT DOCUMENTS 2,254,431 9/1941 Marden et al. ..... 176/122
2,465,123 3/1949 Ruff et al. ..... 176/122
3,651,366 3/1972 Giannini ..... 313/610 X
3,671,796 6/1972 Passamante ..... 313/204

FOREIGN PATENT DOCUMENTS 76745 5/1982 Japan ..... 313/610
57-118359 7/1982 Japan .

*Primary Examiner*—Kenneth Wieder
*Attorney, Agent, or Firm*—Hill, Van Santen, Steadman & Simpson

[57] ABSTRACT

A flashbulb wherein short radii curvatures are allowed for a curved plasma channel without overloading the walls, so that a high luminance is obtained. The discharge space (9) between two electrodes (4, 5) is annularly formed. The outside wall (1) forms a closed hollow cylinder of glass. The outside wall (1) forms a closed hollow cylinder of glass. The inside walls (7, 8) are composed of white ceramic material which is hermetically fused to the glass.

6 Claims, 1 Drawing Sheet

FLASHBULB WITH A HEAT SHIELD

BACKGROUND OF THE INVENTION

1. Field of the Invention

This invention is related in general to flashbulbs which are mounted in a housing in which two electrodes are mounted and 2. Description of the Prior Art U.S. Pat. No. 3,671,796 discloses a flashbulb wherein two electrodes are mounted in a housing and project into a discharge space with sidewalls shaped and arranged such that a discharge space which is shaped roughly like a helix exists between the two electrodes. The inside walls of the housing are formed of glass or silica which is the same as the outside walls of the housing and are hermetically fused to each other.

U.S. Pat. No. 2,255,431 discloses a fluorescent lamp which has a housing with inside walls which are arranged such that an annular discharge space exists betwen the two electrodes. The housing is formed of two vitreous cast members hermetically fused to each other and the inside walls of the housing are also composed of glass.

U.S. Pat. No. 2,465,123 discloses a fluorescent lamp which has the housing formed of two vitreous cast members and between them there is a dividing disc of vitreous material so as to form a discharge space.

Patent Abstracts of Japan, Vol. 6, No. 215 E138, 1093 of Oct. 28, 1982 and GP-A 57-118359. This publication shows a fluorescent lamp which has a trough-shaped housing formed of glass with inside walls of one piece with the housing and are mounted for forming a discharge space having a zigzag shape. The housing is closed with a plate of crystalline ceramic which has good reflection properties for visible light. Since the ceramic plate represents an outside wall of the housing this does not teach forming an inside wall of the housing of ceramic material.

SUMMARY OF THE INVENTION

In the invention, so as to achieve high luminance, a flashbulb is formed which can be bent into a ring and an optimally type closed ring is ideal both from the viewpoint of symmetry as well as from for the imaging properties in the reflector.

The bending radius of a glass tube can be made relatively small, but the discharge which occurs in the tube stresses the tube walls greatest at the inside of the curve. Such stress, therefore, increases when the bending radius is reduced and can lead to evaporation of the glass.

It is an object of the present invention to provide a flashbulb which prevents the overstressing at curve portions which have small radiuses so as to provide a narrow sharply curved discharge space.

The object of the invention is achieved in that the discharge space is annular between the two electrodes and the outside walls are composed of glass and the inside walls are composed of white ceramic material which is hermetically fused to the glass. Ceramic material resist the arc significantly better than glass and, thus, the discharge space can be greatly curved.

Other objects, features and advantages of the invention will be apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
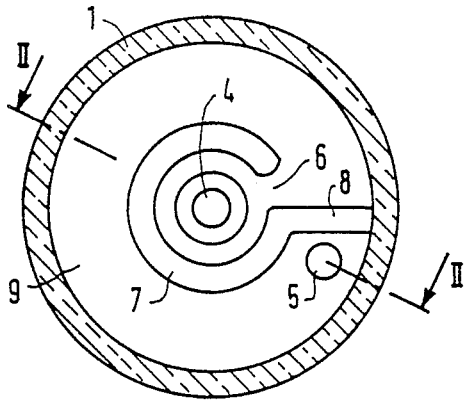
FIG. 1 is a sectional view of a flashbulb of the invention.
Figure 2:
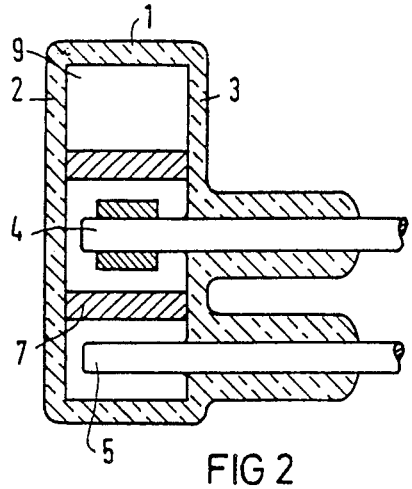
FIG. 2 is a sectional view along line II—II of the device in FIG. 1.

FIGS. 1 and 2 illustrate a flashbulb according to the invention which includes a housing that has an outside wall 1 formed of glass. The housing has an end wall 2 and a second end wall 3 as illustrated in FIG. 2, for example. A first electrode 4 is centrally fused into the end 3 and a second electrode 5 is fused into the end wall 3 and is offset from the center as illustrated in FIGS. 1 and 2. A ceramic 7 partition substantially surrounds the electrode 4 as illustrated in FIG. 1 except for an opening 6 formed therein and is attached to the housing 1 with a projection 8 which is fused to the outside wall 1. The partition 7 surrounds the electrode 4 and is mounted between the electrodes 4 and 5 as illustrated. The electrode 5 is located between the outside wall 1 of the housing and ceramic partition 7. The ceramic partition 7 is formed of white ceramic material which reflects light radiation occurring in the annular discharge space 9 very well toward the outside of the housing. The ceramic partition 7 is hermetically fused to the glass sidewall 1 since it is attached to the projection 8 and the partition 7 forces the discharge to take an annular path through the opening 6 and around the outer surface of the partition 7 to the electrode 5 which comprises the cathode of the device. It is clear from FIGS. 1 and 2 that the discharge space lies substantially in the same plane.

Figure 3:
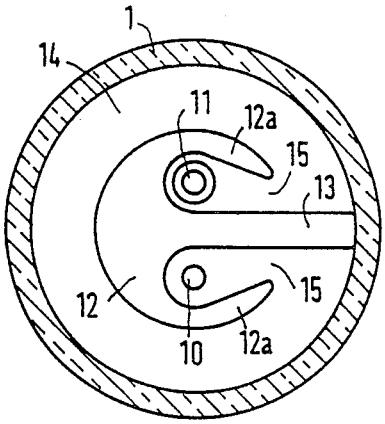
FIG. 3 is a sectional view through a modification of the flashbulb of the invention.

FIG. 3 is a modification of the invention which is a sectional view similar to FIG. 1 wherein an outer glass wall 1 of cylindrical-shape is provided with end walls, not shown, which are attached to the hollow cylindrical outside wall 1. Two electrodes 10 and 11 are mounted in the end wall of the flashbulb and extend parallel to each other and are both offset from the center of the housing. A T-shaped ceramic partition 12 of white ceramic material has projections **12*a* which substantially surround the electrodes 10 and 11. A middle projection 13 of the ceramic partition 12 extends to the outside wall 1 and is hermetically fused thereto so as to support the partition 12. In the example of FIG. 3, an arc between the electrodes 10 and 11 is forced to take an annular path in the annular discharge space 14 from the electrode 11 which forms the anode to the electrode 10 which forms the cathode. The two openings 15 adjacent the projections 12*a* and 12*a* allow the passage of the discharge into the discharge space 14**.

Figure 4:
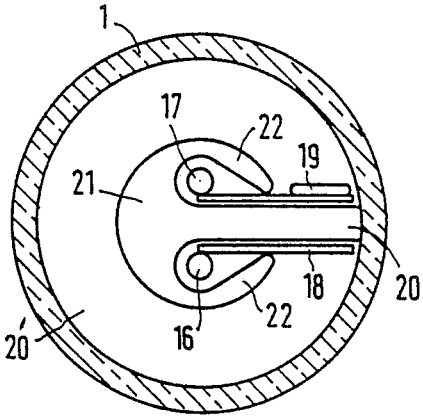
FIG. 4 is a sectional view through a further modification of a flashbulb of the invention.

FIG. 4 illustrates a modification of the invention which differs from the embodiment illustrated in FIG. 3. A pair of parallel mounted electrodes 16 and 17 are attached to the bottom wall of the housing and extend parallel to each other as shown. A white ceramic partition 21 has a middle projection 20 which is fused to the glass wall 1 of the housing. Conductor members 18 and 19 are electrically connected to the electrodes 16 and 17 and extend into the space 20 of the housing. The legs 22 of the partition 21 substantially enclose the electrodes 16 and 17 and bear against the conducting members 18 and 19 as shown and the discharge occurs between the conducting members 19 and 18 through the annular shape discharge path 20.

Figure 5:
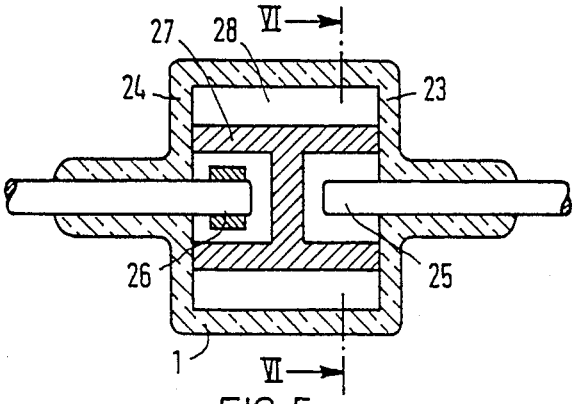
FIG. 5 is a sectional view of an additional embodiment of the invention of a flashbulb.
Figure 6:
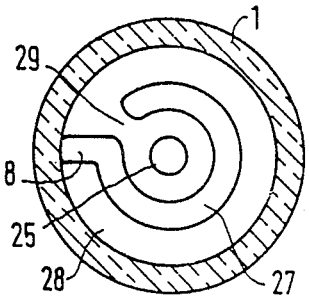
FIG. 6 is a sectional view taken on line VI—VI from FIG. 5.

FIGS. 5 and 6 illustrate a further embodiment of the invention wherein a cylindrical-shape outside wall 1 has a first end member 24 attached to one end thereof and a second end member 23 attached to the other end thereof. The wall 1 and the ends 23 and 24 are formed of glass and are fused to each other. A first electrode 25 extends through the end wall 23 and is fused thereto and extends into the inside cavity of the housing 1. A second electrode 26 is fused to the end member 24 and extends into the housing 1 as shown. The electrodes 25 and 26 are surrounded by a ceramic partition 27 made of white ceramic material which as shown in the sectional view of FIG. 5 has an H-shape and which is hermetically fused to the end portion 23 and to the end portion 24 and has openings so as to form an annular discharge space as a plasma channel between the electrodes 26 and 25. One of these openings 29 is shown in FIG. 6 and there is also a second opening adjacent the electrode 26 so that the plasma discharge can occur between the electrodes 26 and 25 in the curve discharge path 28.

The flashbulb illustrated in FIGS. 5 and 6 is very compact since the inside space of the core is used by the electrodes 25 and 26 and they are axially arranged which saves space in the device.

Although the invention has been described with respect to preferred embodiments, it is not to be so limited as changes and modifications can be made which are within the full intended scope of the invention as defined by the appended claims.

We claim as our invention:

1. A flashbulb comprising a cylindrical housing (1, 2, 3, 23, 24) having outside walls (2, 3, 23, 24) and inside walls (**7, 8, 12, 12*a*, 21, 22, 27) in which two electrodes (4, 5, 10, 11, 16, 17, 25, 26) are fused, and said two electrodes project into a discharge space (9, 14, 20′, 28) characterized in that the discharge space (9, 14, 20′, 28) extends circumferentially around the cylindrical housing substantially in the same plane between said two electrodes (4, 5, 10, 11, 16, 17, 25, 26); and said outside walls (2, 3, 23, 24) are composed of glass and the inside walls (7, 8, 12, 12*a*, 13, 20, 22, 27**) are formed of white ceramic material which is hermetically fused to said glass of said outside walls.

2. A flashbulb according to claim 1, characterized in that said bulb is formed as a hollow cylinder which is closed at the top and bottom and one electrode (4) of said two electrodes is centrally fused into said bottom and a second electrode (5) of said two electrodes is excentrically fused into said bottom and a ceramic partition (7) surrounds said central one electrode (4) and leaves an opening (6) which is free that lies between said one and second electrodes (4, 5), said ceramic partition has a projection (8) which is fused to said outside wall (1), and said second electrode (5) lies between said outside wall (1) and said ceramic partition (7).

3. A flashbulb according to claim 1, characterized in that the bulb is formed as a hollow cylinder which is closed at the top and bottom and said two electrodes (10, 11, 16, 17) are excentrically fused to said top or bottom and a generaly T-shaped ceramic partition (**12, 12*a*, 21, 22) forms said inside wall and surrounds said two electrodes (10, 11, 16, 17), and has a projection (13, 20) which extends from its middle that is fused to said outside wall (1**).

4. A flashbulb according to claim 3, characterized in that both legs (**12*a*) of said ceramic partition (12) form openings (15) for the passage of a discharge into a discharge space (14**) formed in said housing.

5. A flashbulb according to claim 3, characterized in that said two electrodes (16, 17) are completely surrounded by the legs (22) of said ceramic partition (21) and conductor members (18, 19) extend into an annular discharge space (20 formed in the housing.

6. A flashbulb according to claim 1, characterized in that the bulb is formed as a hollow cylinder which is closed at its top and its bottom and into said top (23) and said bottom one of said two electrodes (25, 26) are, respectively, centrally fused; and said two electrodes (25, 26) are surrounded by a ceramic partition member (27) which has an H-shape in its longitudinal section and which has openings (29) so as to form a plasma channel (28).

* * * * *